US005806384A

United States Patent [19]

Foster

[11] Patent Number: 5,806,384

[45] Date of Patent: Sep. 15, 1998

[54] EMERGENCY VALVE SHUT-OFF WRENCH

[76] Inventor: William J. Foster, 12680 4th St., Sp. #49, Yucaipa, Calif. 92399

[21] Appl. No.: 958,935

[22] Filed: Oct. 28, 1997

Related U.S. Application Data

[63] Continuation-in-part of Ser. No. 667,085, Jun. 20, 1996, abandoned.

[51] Int. Cl.[6] ..... B25B 13/56

[52] U.S. Cl. ..... 81/176.1; 81/124.7; 81/180.1

[58] Field of Search ..... 81/119, 121.1, 81/124.2, 124.3, 124.7, 176.1–176.2, 180.1, 186, 60

[56] References Cited

U.S. PATENT DOCUMENTS

| | | | |
|---|---|---|---|
| 2,858,710 | 11/1958 | Landwehr et al. . | |
| 3,398,612 | 8/1968 | Batten . | |
| 3,533,315 | 10/1970 | Maeda | 81/60 |
| 4,258,595 | 3/1981 | Ramsey . | |
| 5,193,418 | 3/1993 | Benrenfeld | 81/180.1 X |
| 5,392,672 | 2/1995 | Larson et al. | 81/60 |

*Primary Examiner*—James G. Smith
*Attorney, Agent, or Firm*—Sheldon & Mak

[57] ABSTRACT

An emergency shut-off wrench for a fluid gate-valve includes a handle having shank and head portions; a plug for engaging the head portion of the handle, the plug having an engagement surface for coupling rotational movement to a gate of the valve, the gate being rotatable approximately 90° between open and closed positions; and a stop rigidly fixable in projecting relation to the plug for preventing further rotation of the gate beyond a predetermined position thereof when the plug is engaging the gate. The plug is rotatably connected to the head portion and respective dogs make abutting engagement between the plug and the head portion at a predetermined angular orientation with the handle for transmitting torque between the handle and the plug in a magnitude sufficient for rotation of the gate in one direction only. The plug can be threadingly engagable with the head portion. The stop can include a stem member that is eccentrically mounted to the handle and fixably held relative to the handle for adjusting an angular orientation of the gate when the stop contacts the fluid line.

16 Claims, 2 Drawing Sheets

EMERGENCY VALVE SHUT-OFF WRENCH

RELATED APPLICATION

This application is a continuation-in-part application Ser. No. 08/667,085, filed on Jun. 20, 1996, which is incorporated herein by reference now abandon.

BACKGROUND

The present invention relates to valve handles, and more particularly to wrenches for operating gate valves and the like as are commonly found in utility gas lines.

In emergencies such as earthquakes and fires it is often desired to quickly shut off utility gas service to structures that are or may be affected by the emergency. Normally, a shut-off valve is connected in a service line upstream of a meter that is accessible outside of the structure. Typically, the shut-off valve is a gate valve wherein a rotary gate member moves from an open position wherein a projecting blade portion of the gate member is aligned with the service line, and a closed position wherein the blade portion is cross-wise with the service line. This type of gate valve is generally inoperative without the assistance of a wrench or other suitable tool. Such tools may or may not be readily available to service customers under normal conditions, but typically the tools are "safely" stored within the structure if they are on hand at all.

Thus it has been advocated to keep a suitable wrench stored proximate each gas service valve for emergency use. However, shut-off valves and gas meters are not generally adapted for conveniently storing suitable wrenches. More importantly, a further hazard is presented in many cases when the service valve is closed and subsequently reopened in that gas may leak from unlighted pilots or undiscovered breaks in the line. Consequently, many gas utility providers are reluctant to recommend that emergency wrenches be provided at service valves, citing the safety hazard of unauthorized turning on of the gate valve, preferring that the valves be turned on by authorized personnel only.

Thus there is a need for an emergency valve shut-off wrench that overcomes the disadvantages of the prior art, that can be stored at the meter, and that can not be used to open the fluid gate valve.

SUMMARY

The present invention meets this need by providing an emergency shut-off wrench for a fluid gate-valve that is rigidly connected in a fluid line and having a gate member that is rotatable approximately 90 degrees between respective open and closed positions. The wrench includes a handle member having a shank portion and a head portion; a plug member for engaging the head portion of the handle member, the plug member having an engagement surface for coupling rotational movement to the gate member of the valve; means for transmitting torque between the handle member and the plug member in a magnitude sufficient for rotation of the gate member in one direction only; and a stop member rigidly fixable in projecting relation to the plug member for preventing further rotation of the gate member beyond a predetermined position thereof when the plug member is engaging the gate member and transmitting the torque.

In one aspect of the invention, the plug member is rotatably mounted to the handle member, the means for transmitting including a dog member being circumferentially fixable on one of the plug member and the handle member for engaging a stop surface that is fixed relative to the other of the plug member and the handle member at a predetermined angular orientation of the plug member relative to the handle member. The dog member can include a threaded fastener having a projecting head portion. The fastener can be selectively located in one of a plurality of threaded openings being formed in the one of the plug member and the handle member for producing the abutting contact at a selectable angular orientation of the plug member relative to the handle member. Alternatively, the dog member can include a radially oriented spring plunger.

In another aspect of the invention, the means for transmitting includes the plug member being threadingly engagable with the head portion, the plug member making abutting engagement with the head portion at a predetermined angular orientation relative to the handle member. Preferably the abutting engagement is with circumferentially facing contact between respective dog members that are fixably located on the plug and handle members in eccentric relation to the plug member for preventing binding between the plug and handle members. The plug member can have a threaded stem portion of diameter C, the abutting engagement being preferably outside the diameter C for limiting loading of the dog members.

The engagement surface of the plug member can have an effective length $\ell$ in a direction normal to a rotational axis of the plug member, the plug member having threaded contact with the handle member within a diameter being less than the length $\ell$ for limiting the transmission of torque from the handle member to the plug member in a direction opposite the one direction. Preferably the plug member has a threaded stem portion for engaging the handle member, the stem portion having an outside diameter C being less than the length $\ell$. The wrench can further include a projection projecting concentrically with the stem portion for making axially abutting contact between the plug member and the handle member within a diameter d, the diameter d being less than the diameter C.

The stop member can include a stem member that is eccentrically mounted to the handle member for contacting the fluid line, and means for fixably holding the stem member relative to the handle member, for adjusting an angular orientation of the gate member when the stop member contracts the fluid line. The wrench can further include a spring clip fastened to the handle member for gripping the fluid line.

DRAWINGS

These and other features, aspects, and advantages of the present invention will become better understood with reference to the following description, appended claims, and accompanying drawings, where:

DESCRIPTION

Figure 1:
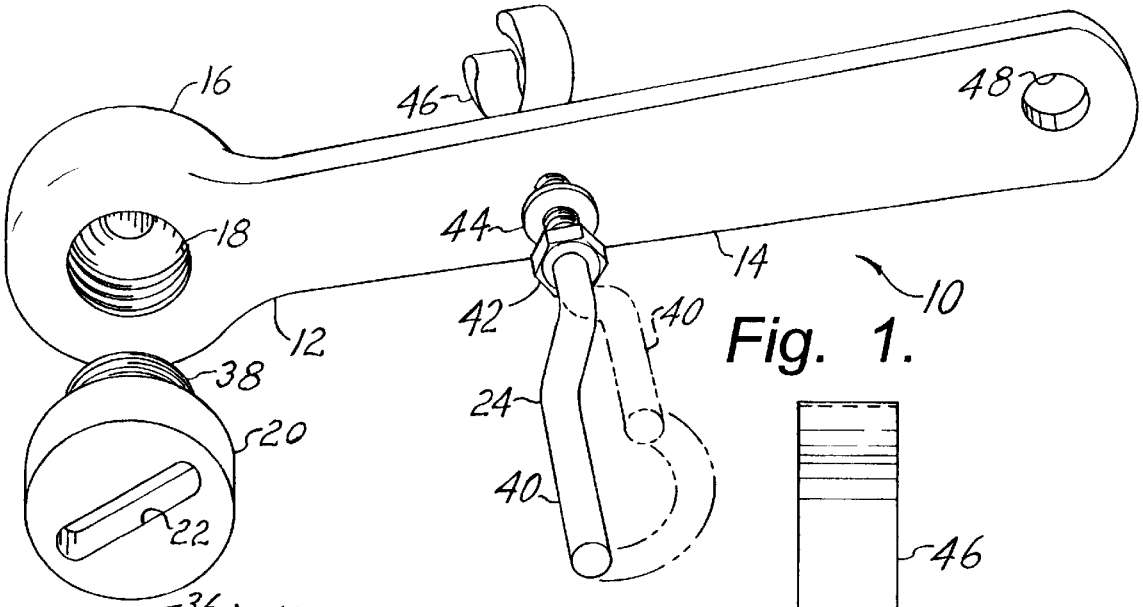
FIG. 1 is a partially exploded perspective view of an emergency valve shut-off wrench according to the present invention.
Figure 2:
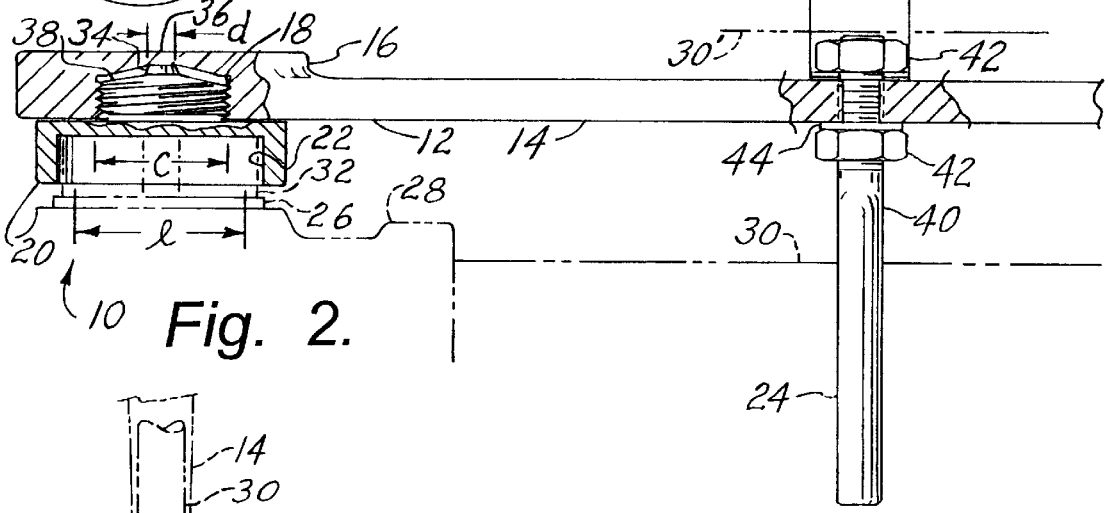
FIG. 2 is a fragmentary sectional view of the wrench of FIG. 1.
Figure 3:
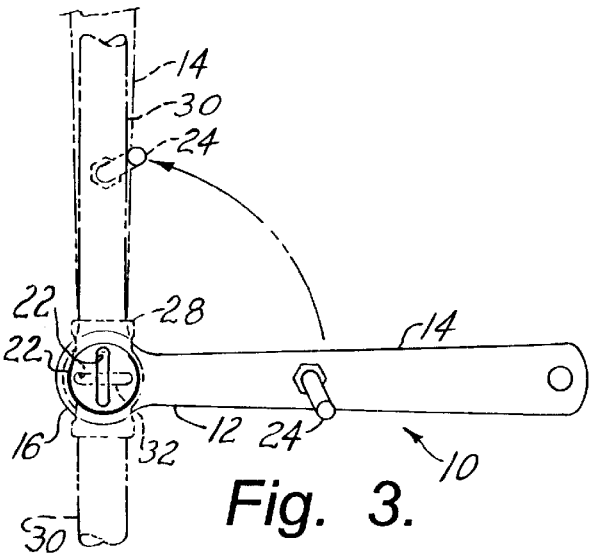
FIG. 3 is an elevational view showing the wrench of FIG. 1 in use in connection with a gate valve.

The present invention is directed to an emergency wrench that is particularly effective for one-way operation of a fluid valve such as a utility gas shut-off valve. With reference to FIGS. 1–3 of the drawings, a wrench 10 includes a handle member 12 having a shank portion 14 and a head portion 16, a threaded cavity 18 being formed therein, a plug member 20 threadingly engagable with the cavity 18 and having a slot 22 formed therein, and a stop member 24 projecting from an intermediate location along the shank portion 14. The slot 22 is adapted for engagement with a gate member 26 of a fluid valve 28 that is rigidly connected in a fluid line 30. Typically, the fluid line 30 is a utility gas pipe that is connected to the inlet of a utility gas meter (not shown). A projecting blade 32 of the gate member 26 is normally aligned with the line 30 in an open position of the valve 28, being rotated approximately 90 degrees from such alignment in a closed position of the valve 28.

A principal feature of the present invention is that sufficient torque for rotating the gate member 26 of the valve 28 can be transmitted in one direction only from the handle member 12 to the plug member 20, in combination with the stop member 24 limiting rotation of the handle member 12 when the plug member 20 is engaging the gate member 26. Particularly, the stop member 24 projects to one side of the fluid line 30 as shown in FIG. 2 when the blade 32 of the gate member 26 is seated within the slot 22 of the plug member 20. In the following description, right-handed threaded engagement of the plug member 20 with the cavity 18 is assumed, it being understood that left-handed engagement is also possible within the scope of the present invention.

FIG. 3 shows the wrench 10 in a starting position engaging the blade 32 in the open position of the valve 28 as indicated by solid lines, the handle member 12 projecting approximately at right angles to the fluid line 30. The valve 28 and the line 30 are shown by dashed lines as transparent, being in front of the wrench 10. Movement of the shank portion 14 in a counterclockwise direction as viewed in FIG. 3 produces a corresponding rotation of the gate member 26, the valve 28 becoming fully closed when the handle member 12 is approximately aligned with the fluid line 30 as indicated by dashed lines in FIG. 3. The plug member 20 is maintained rigidly coupled to the handle member 12 by the clockwise threaded engagement with the cavity 18, the plug member 20 becoming more tightly coupled to the head portion 16 during such tightening. Further counterclockwise movement of the shank portion 14 is prevented by the stop member 24 coming against the fluid line 30. In case a user of the wrench 10 attempts to reverse the rotation of the gate member 26, the plug member 20 proceeds to disengage from the handle member 12 by unscrewing from the cavity 18. This disengagement is promoted by a center projection 34 of the plug member 20 engaging a wall portion 36 of the head portion 16 at a diameter d that is sufficiently large for sustaining compressive loads produced by operation of the wrench 10 but smaller than an outside diameter C of a threaded stem portion 38 of the plug member 20, the diameter C also being less than an effective length of engagement $\ell$. The threaded engagement is preferably somewhat coarse (in terms of lead per revolution) for limiting the compressive loading when torque is applied to the threaded engagement. Also, the threaded engagement between the plug member 20 and the handle 12 is preferably slightly loose-fitting for promoting unthreading rotation of the plug member whenever reverse torque is applied. The slot 22 can be formed in a desired angular orientation relative to the threaded engagement using any of several conventional means, such as by assembling the plug member 20 with the handle member 12 prior to formation of the slot 22. More efficient means include forming the threaded portion of the cavity 18 in a repeatable orientation relative to the handle member 12, in combination with assembly of the plug member 18 into a threaded fixture cavity having like orientation prior to formation of the slot 22. Also, the threaded configuration of the stem portion 38 can be completed in a repeatable orientation using tooling that engages the (previously formed) slot 22.

As further shown in FIGS. 1–3, the stop member 24 is adjustably fixable relative to the handle member 12 for accommodating variously sized fluid lines 30 and for canceling variations in the orientation of the slot 22 relative to the handle 12 in the assembled condition of the wrench 10. An exemplary configuration of the stop member 24 includes a Z-shaped rod 40 having threaded engagement with the shank portion 14, a lock-nut 42 and washer 44 being provided for securing the rod 40 in a desired rotational orientation relative to the handle member 12. It is contemplated that the stop member 24 would be adjusted for indexing the gate member 26 approximately centered in its fully closed position when the rod 40 comes into contact with the fluid line 30.

As described above, the stem portion 38 of the plug member 20 is threaded right-handed, it being understood, of course, that the stem portion 38 can be threaded oppositely (left-handed), the direction of rotation of the handle member 12 in operation of the wrench 10 being correspondingly reversed without substantially altering the utility of the wrench 10. This is because gate valves of the type described above are operable in either direction and the side of the fluid line 30 against which stop member 24 rests upon closure of the valve 28 is not normally critical.

Preferably the wrench 10 is supported prior to use in convenient proximity to the valve 28. In the exemplary configuration shown in the drawings, a spring clip 46 is affixed to the handle member 12 for releasably gripping the fluid line 30 as indicated at 30' in FIG. 2. As shown in FIG. 2, a counterpart of the lock-nut 42 holds the spring clip 46 against the shank portion 14 of the handle member 12 on the rod 40 opposite the plug member 20. The handle 12 is also formed having an opening 48 therethrough for hanging the wrench 38 on any suitable hook (not shown).

Figure 4:
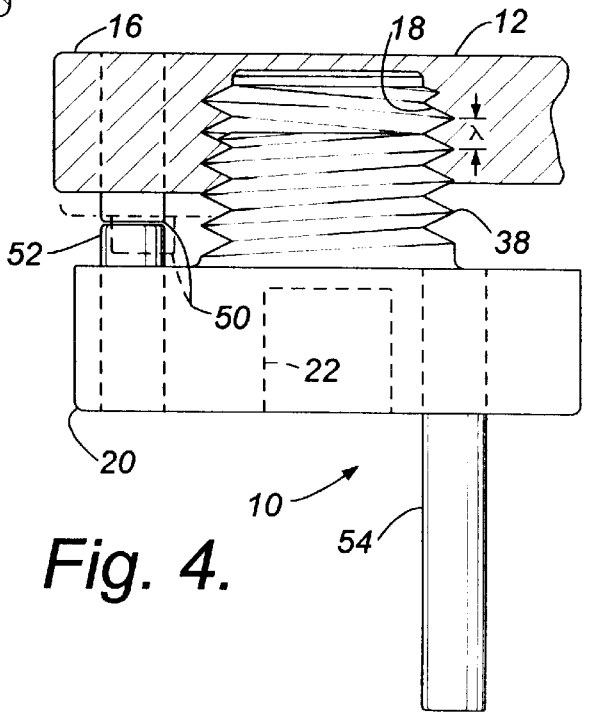

With further reference to FIG. 4, a preferred alternative configuration of the wrench 10 has the means for unidirectional torque transmission implemented by the plug member engaging a rotational stop dog 50 that is rigidly located on the head portion 16 of the handle 12 for avoiding axial loading between the plug member 20 and the handle 12. Thus the stem portion 38 does not make bottoming engagement with the threaded cavity 18. Particularly, the stop dog 50 is located outside of the cavity 18, a head dog 52 rigidly projecting from the plug member toward the stop dog 50 for producing circumferentially facing contact between the dogs 50 and 52 at a predetermined amount of the threaded advancement of the stem portion 38 into the cavity 18. Preferably, the head dog 52 axially overlaps the stop dog 50 by only slightly less than a lead $\lambda$ of the threaded engagement for enhanced overlap of the dogs 50 and 52 in the abutting condition as shown by solid lines in FIG. 4. As in the previously described implementation of FIGS. 1–3, rotation of the handle 12 in a direction opposite that producing rotation of the gate member 26 causes unscrewing of the plug member 20 from the cavity 18, the dogs 50 and 52 passing in close proximity at one revolution from the engaged condition as shown by broken lines in FIG. 4.

As further shown in FIG. 4, a counterpart of the stop member, designated 54, rigidly projects from the plug member 20 in a predetermined radially spaced relation with the slot 22, the spring clip 46 being attached to the handle 12 by any suitable fastener such as a headed screw (not shown). It will be understood that a stop member having the offset configuration of FIGS. 1–3 can extend from the plug member 20, provided that a suitably strong mounting thereof is effected. Such mounting can lockably secure the stop member in a selected one of a plurality of discrete angular orientations.

Figure 6:
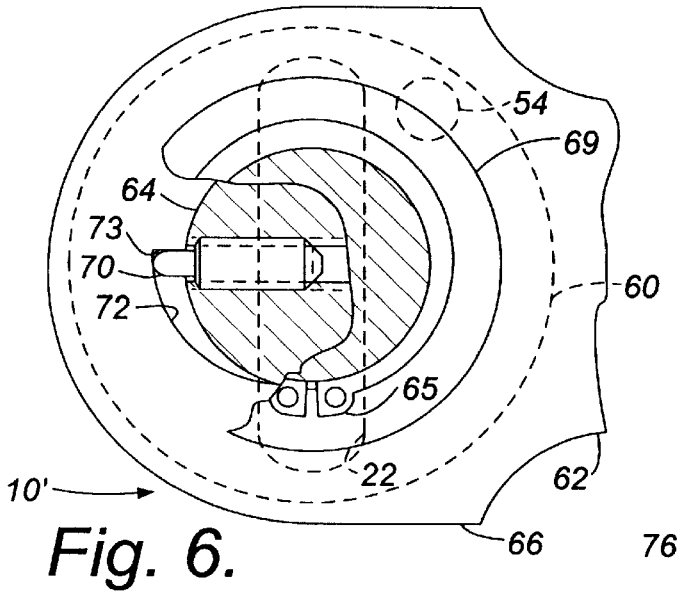
FIG. 6 is a top view of FIG. 5.
Figure 5:
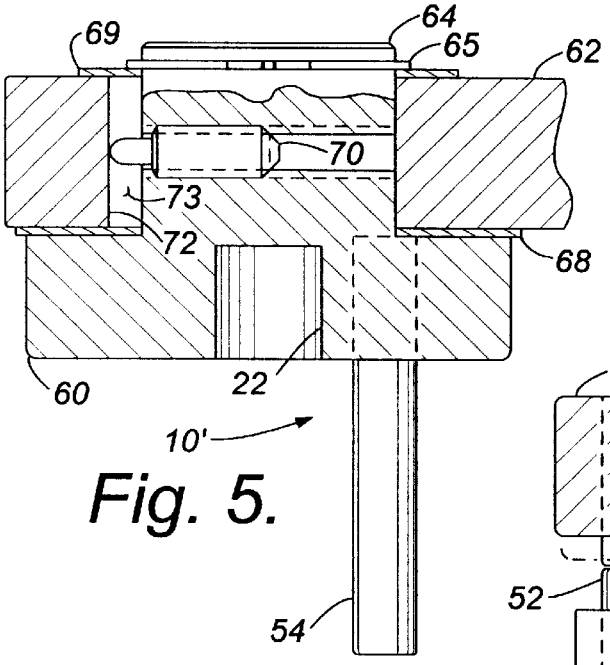
FIG. 5 is a third embodiment with a plunger stop element.

With further reference to FIGS. 5 and 6, another alternative configuration of the wrench, designated 10', has a plug member 60 that is rotationally supported in a counterpart of the handle member, designated 62. A shank portion 64 of the plug member 60 is formed for receiving a retaining ring 65, a head portion 66 of the handle member 62 being retained by the ring 65 between a large washer 68 and a small washer 69. A spring plunger 70 is threadingly retained transversely in the shank portion 64, projecting radially outwardly for engaging an inside ramp surface 72 of the head portion 66, the rotational torque being transmitted from the handle 62 to the valve 28 when the plunger 70 engages a stop portion 73 of the ramp surface 72. In the configuration of FIGS. 5 and 6, the spring plunger 70 corresponds to the head dog 52, the stop portion 73 of the ramp surface 72 corresponding to the stop dog 50 (FIG. 4). It will be understood that the ramp surface 72 can be formed on the plug member, the spring plunger 70 being inwardly oriented in the handle member 12. Advantageously, reversal of the assembly of the plug member 60 with the handle 62 is possible upon removal of the retaining ring 65, yet the removal typically requires a special snap-ring tool that is not generally carried by those that might wish to open the valve 28 after it has been closed by the wrench 10'.

Figure 7:
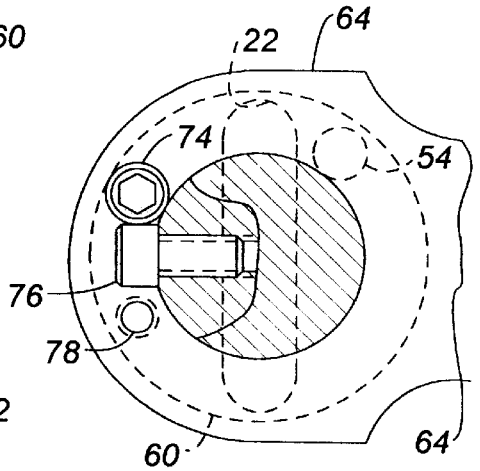
FIG. 7 is a fourth embodiment with a threaded member stop element.

With further reference to FIG. 7, an alternative configuration of the wrench 10' incorporates counterparts of the stop dog 50 and the head dog 52 in the form of respective stop fasteners 74 and 76. The stop fasteners 74 and 76 are socket head cap screws, the heads of which make the abutting contact in substantially circumferentially facing relation. The stop fastener 76 extends transversely into the shank portion 64, being axially located for retaining the plug member 60 rotatably engaged with the handle member 12. Thus the stop fastener 76 replaces the retaining ring 65 of FIGS. 5 and 6. Also, the washers 68 and 69, being optional, are not included in the configuration of FIG. 7.

As further shown in FIG. 7, a threaded opening 78 is formed in the handle head portion 66 for providing a selectable alternative location for the stop fastener 74, the fastener 74 threadingly engaging a counterpart of the opening 78 (not shown). Thus the angular orientation of the slot 22 relative to the handle member 12 is selectively adjustable by means of locating the stop fastener 74 in one or the other of the threaded openings 78. In the configuration of FIG. 7, reversal of movement of the gate member is prevented by suitably locating the stop member 54 and the stop fasteners 74 and 76 relative to the slot 22, whereby the stop member 54 engages the valve 28 or the lone 30 prior to abutting engagement between the fasteners 74 and 76 when the handle member 12 is moved in the direction opposite that in which the valve 28 is closed.

Although the present invention has been described in considerable detail with reference to certain preferred versions thereof, other versions are possible. For example, when the stop member 54 projects from the head portion 16 of the handle 12, the shank portion 14 of the handle can be threadingly connected to the head portion. Also, the wrench 10 can be stored with the plug member pressed onto the blade portion of the gate member. Further, when the stop member 54 extends from the plug member 20, the handle 12 can be coupled to that combination by a one-way ratchet mechanism. Therefore, the spirit and scope of the appended claims should not necessarily be limited to the description of the preferred versions contained herein.

What is claimed is:

1. An emergency shut-off wrench for a fluid gate-valve, the gate-valve being rigidly connected in a fluid line and having a gate member, the gate member being rotatable approximately 90 degrees between respective open and closed positions thereof, the wrench comprising:

(a) a handle member having a shank portion and a head portion;

(b) a plug member for engaging the head portion of the handle member, the plug member being rotatably and supportively engagable with the handle member and having an engagement surface for coupling rotational movement to the gate member of the valve;

(c) means for transmitting torque between the handle member and the plug member in a magnitude sufficient for rotation of the gate member in one direction only; and (d) a stop member rigidly fixable on the plug member when the plug member is transmitting the torque for preventing further rotation of the gate member beyond a predetermined position thereof when the plug member is engaging the gate member.

2. The wrench of claim 1, wherein the plug member is rotatably mounted to the handle member, the means for transmitting comprising a dog member being circumferentially fixable on one of the plug member and the handle member, the other of the plug member and the handle member having a stop surface being fixed relative thereto, the dog member making circumferentially abutting engagement with the stop surface at a predetermined angular orientation of the plug member relative to the handle member.

3. The wrench of claim 2, wherein the dog member comprises a threaded fastener having a projecting head portion.

4. The wrench of claim 3, wherein the one of the plug member and the handle member is formed having a plurality of threaded openings for selectively receiving the threaded fastener, whereby the predetermined angular orientation is one of a corresponding plurality of selectable angular orientations of the plug member relative to the handle member.

5. The wrench of claim 2, wherein the dog member comprises a radially oriented spring plunger.

6. The wrench of claim 1, wherein the means for transmitting comprises the plug member being threadingly engagable with the head portion, the plug member making abutting engagement with the handle member at a predetermined angular orientation of the plug member relative to the handle member.

7. The wrench of claim 6, comprising respective dog members fixedly located on the plug member and the handle member in eccentric relation to the plug member, the dog members making the abutting engagement at the predetermined angular orientation.

8. The wrench of claim 7, wherein the plug member has a threaded stem portion for engaging the handle member, the stem portion having an outside diameter C, the abutting engagement being outside of the outside diameter C.

9. The wrench of claim 6, wherein the engagement surface of the plug member has an effective length $\ell$ in a direction normal to a rotational axis of the plug member, the plug member having threaded contact with the handle member within a diameter being less than the length $\ell$ for limiting the transmission of torque from the handle member to the plug member in a direction opposite the one direction.

10. The wrench of claim 9, wherein the plug member has a threaded stem portion for engaging the handle member, the stem portion having an outside diameter C being less than the length $\ell$.

11. The wrench of claim 10, further comprising a center projection projecting concentrically with the stem portion for making axially abutting contact between the plug member and the handle member within a diameter d, the diameter d being less than the diameter C.

12. The wrench of claim 1, wherein the stop member comprises a stem member, the stem member being eccentrically mounted to the handle member, and means for fixably holding the stem member relative to the handle member.

13. The wrench of claim 1, wherein the stop member comprises a stem member, the stem member being mounted to the plug member.

14. The wrench of claim 1, further comprising a spring clip fastened to the handle member for gripping the fluid line.

15. An emergency shut-off wrench for a fluid gate-valve, the gate-valve being rigidly connected in a fluid line and having a gate member, the gate member being rotatable approximately 90 degrees between respective open and closed positions thereof, the wrench comprising:

(a) a handle member having a shank portion and a head portion;

(b) a plug member for engaging the head portion of the handle member, the plug member having an engagement surface for coupling rotational movement to the gate member of the valve, the plug member being rotatably mounted to the handle member;

(c) a dog member being circumferentially fixed on one of the plug member and the handle member, the other of the plug member and the handle member having a stop surface being fixed relative thereto, the dog member making circumferentially abutting engagement with the stop surface at a predetermined angular orientation of the plug member relative to the handle member at a predetermined angular orientation with the handle member for transmitting torque between the handle member and the plug member in a magnitude sufficient for rotation of the gate member in one direction only;

(d) a stop member rigidly fixed on the plug member for preventing further rotation of the gate member beyond a predetermined position thereof; and (e) a spring clip fastened to the handle member for gripping the fluid line.

16. An emergency shut-off wrench for a fluid gate-valve, the gate-valve being rigidly connected in a fluid line and having a gate member, the gate member being rotatable approximately 90 degrees between respective open and closed positions thereof, the wrench comprising:

(a) a handle member having a shank portion and a head portion;

(b) a plug member for engaging the head portion of the handle member, the plug member having an engagement surface for coupling rotational movement to the gate member of the valve, the plug member having a threaded stem portion for threadingly engaging the head portion of the handle member, the plug member making abutting engagement with the head portion at a predetermined angular orientation with the shank portion of the handle member for transmitting torque between the handle member and the plug member in a magnitude sufficient for rotation of the gate member in one direction only, the engagement surface of the plug member having an effective length $\ell$ in a direction normal to a rotational axis of the plug member, the plug member having threaded contact with the handle member within a diameter C being less than the length $\ell$ for limiting the transmission of torque from the handle member to the plug member in a direction opposite the one direction;

(c) a stop member rigidly fixable in projecting relation to the plug member when the plug member is engaging the gate member and to the plug member is transmitting the torque for preventing further rotation of the gate member beyond a predetermined position thereof; and (d) a spring clip fastened to the handle member for gripping the fluid line.

* * * * *